US010639900B2

(12) United States Patent
Gencan et al.

(10) Patent No.: US 10,639,900 B2
(45) Date of Patent: May 5, 2020

(54) CLEANING HEAD AS WELL AS DEVICE AND METHOD FOR CLEANING PRINTING HEADS

(71) Applicant: KHS GmbH, Dortmund (DE)

(72) Inventors: Engin Gencan, Unna (DE); Markus Reiniger, Mönchengladbach (DE); Werner Van De Wynckel, Humbeek (BE)

(73) Assignee: KHS GmbH, Dortmund (DE)

( * ) Notice: Subject to any disclaimer, the term of this patent is extended or adjusted under 35 U.S.C. 154(b) by 39 days.

(21) Appl. No.: 16/097,654

(22) PCT Filed: May 24, 2017

(86) PCT No.: PCT/EP2017/062691
§ 371 (c)(1),
(2) Date: Oct. 30, 2018

(87) PCT Pub. No.: WO2017/207410
PCT Pub. Date: Dec. 7, 2017

(65) Prior Publication Data

US 2019/0160821 A1 May 30, 2019

(30) Foreign Application Priority Data

Jun. 3, 2016 (DE) ..... 10 2016 110 322

(51) Int. Cl.
*B41J 2/165* (2006.01)

(52) U.S. Cl.
CPC ..... *B41J 2/16552* (2013.01); *B41J 2/1652* (2013.01); *B41J 2002/1657* (2013.01)

(58) Field of Classification Search
CPC ..... B41J 2/16552; B41J 2/1652; B41J 2002/1657
See application file for complete search history.

(56) References Cited

U.S. PATENT DOCUMENTS

| | | | | |
|---|---|---|---|---|
| 2011/0074869 | A1 | 3/2011 | Kanata et al. | |
| 2014/0132669 | A1* | 5/2014 | De Roeck | B41J 2/16538 347/35 |
| 2014/0373929 | A1 | 12/2014 | Fukada et al. | |
| 2015/0062240 | A1* | 3/2015 | Kraus | B41J 2/16552 347/25 |

FOREIGN PATENT DOCUMENTS

| | | |
|---|---|---|
| DE | 10 2007 050 490 | 4/2009 |
| DE | 10 2011 002 727 | 7/2012 |
| DE | 10 2013 217 685 | 3/2015 |
| EP | 1 016 528 | 7/2000 |
| EP | 2 540 505 | 1/2013 |
| JP | 2010-247360 | 11/2010 |

* cited by examiner

*Primary Examiner* — Henok D Legesse
(74) *Attorney, Agent, or Firm* — Occhiuti & Rohlicek LLP

(57) ABSTRACT

A cleaning head includes an end face that faces an inkjet print head to be cleaned. A supply opening and a discharge opening are spaced apart on the end face. A supply channel carries cleaning fluid to the supply opening. The discharge opening receives cleaning fluid that is to be conveyed away after having been emitted through the supply opening. The cleaning head emits a cleaning fluid jet through the supply opening with the cleaning fluid jet being emitted in a direction having a component that is directed towards the discharge opening so that the cleaning fluid can be conveyed away by suction through the discharge opening.

20 Claims, 4 Drawing Sheets

Fig. 1
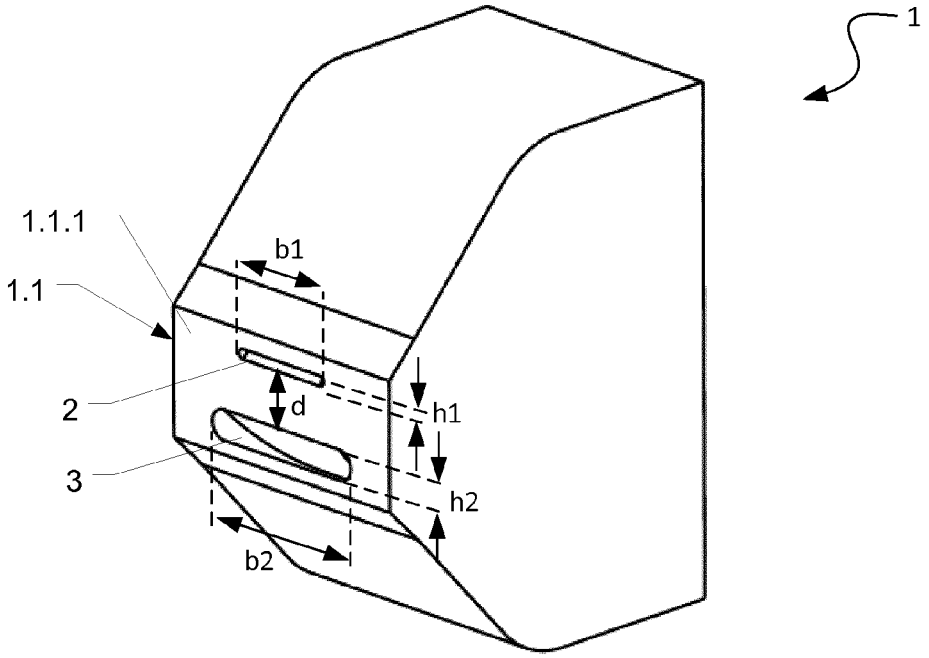
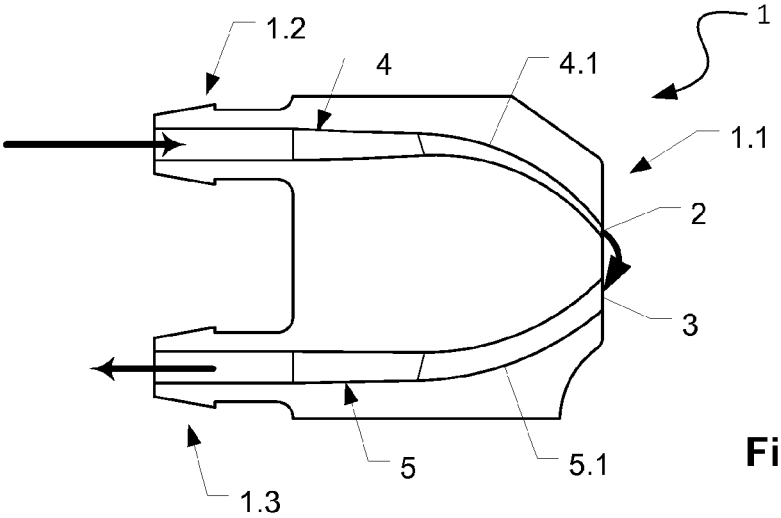
Fig. 2

CLEANING HEAD AS WELL AS DEVICE AND METHOD FOR CLEANING PRINTING HEADS

RELATED APPLICATIONS

This is the national stage under 35 USC 371 of international application PCT/EP2017/062691, filed on May 24, 2017, which claims the benefit of the Jun. 3, 2016 priority date of German application DE 102016110322.5, the contents of which are herein incorporated by reference.

FIELD OF INVENTION

The invention relates to a cleaning head as well as a device and a method for cleaning print heads.

BACKGROUND

A useful way to print on a container is with an ink jet printer. An ink jet printer has a print head that has nozzles. Ink sprays out of the nozzles and onto containers to print images and text.

A difficulty that arises is that dried ink residues eventually interfere with printing. It is therefore necessary to clean the print head from time to time.

SUMMARY

Among the objects of the invention is that of cleaning ink print heads.

According to a first aspect, the invention relates to a cleaning head for cleaning ink jet print heads. The cleaning head comprises a supply opening that emits a cleaning fluid and, at a distance from the supply opening, a discharge opening for conveying away the cleaning fluid.

Cleaning fluid is supplied under pressure in a continuous fluid stream at the supply opening and sucked away at the discharge opening by a vacuum. The supply opening and the discharge opening are arranged on an end face of the cleaning head. The end face faces the printing head during cleaning. It is preferable for the end face to be positioned close to the print head's nozzles. In some embodiments, the distance is between 0.1 millimeters and 2 millimeters.

At the supply opening, the cleaning head emits a cleaning fluid jet that is oriented in the direction of the discharge opening such that the cleaning fluid can be conveyed away at the discharge opening via suction. As a result, the cleaning fluid leaves the supply opening along a flow direction having a component that runs from the supply opening towards the discharge opening.

The directed delivery of the cleaning fluid ensures that, in the region in front of the end face of the cleaning head, there exists a preferably arched cleaning-fluid stream that, after having traversed a travel path in front the end face as a free stream, is directly sucked away again through the discharge opening. In some embodiments, the free-flowing travel path has a path length that is between half a centimeter and two centimeters. In at least some embodiments, the path length is one centimeter. However, other path lengths are possible.

An advantage of the cleaning head is that, as a result of the directed emission of the cleaning fluid from the supply opening to the discharge opening, the cleaning fluid impinges upon only a small region of the printing head, after which it is immediately sucked away. This avoids having cleaning fluid drain from or drip off of the cleaning head.

In some embodiments, the supply opening is above the discharge opening when the cleaning head is arranged in the cleaning position. Embodiments include those in which the distance between the supply opening and the discharge opening is between 0.2 centimeters and 2 centimeters, those in which it is between 0.7 centimeters and 1.5 centimeters, and those in which it is 1 centimeter or approximately 1 centimeter. As a result of the relative placements of the supply opening and the discharge opening, gravity assists in causing the cleaning fluid stream to flow from the supply opening to the discharge opening.

In other embodiments, the supply opening and the discharge opening are slot-like openings. In such embodiments, the opening width of the openings, which is the opening dimension in horizontal direction when the cleaning head is arranged in the cleaning position in front of the printing head, is greater than the opening height. This promotes having the cleaning fluid be provided at the cleaning head in a wide cleaning fluid jet having a minimal fluid jet height.

In other embodiments, the supply opening and the discharge opening are parallel to one another such that the longitudinal axes of the openings run parallel or substantially parallel to each other. This promotes the optimal sucking of the fluid stream provided at the supply opening at the discharge opening.

In some embodiments, the opening width of the discharge opening is greater than the opening width of the supply opening. Among these are embodiments in which the discharge opening and the supply opening are centered relative to a vertical axis so that the discharge opening extends beyond and thus overhangs both sides of the supply opening in a lateral direction so as to for the same lateral overhang on both sides. This promotes adequate suction at the discharge opening even if the fluid jet widens as it traverses the free-flowing path.

In other embodiments, the discharge opening's opening height, which would be the opening dimension in the vertical direction when the cleaning head is arranged in the cleaning position in front of the printing head is greater than the supply opening's opening height. This results in the supply opening's emission of a fluid jet with minimal jet height or jet thickness. The discharge opening's greater opening height makes it possible to achieve adequate suction at the discharge opening even if the fluid jet widens over the free-flowing fluid path.

In some embodiments, the supply opening's free end, which is a section of the supply channel that lies immediately upstream of the supply opening, runs at an angle or curves towards the discharge opening. This means that at least a section of the supply channel running in the interior of the cleaning head curves towards the discharge opening or runs at an angle towards the discharge opening. As a result of this configuration, the supply opening directs cleaning fluid towards the discharge opening.

Other embodiments feature a deflector that deflects the cleaning fluid jet towards the discharge opening. Such a deflector is located at the supply opening.

In preferred embodiments, the freely emitted fluid jet exits the supply opening and the jet as it enters the discharge opening define two directions that enclose an angle between them. This angle is between zero and 180 degrees. However, in most embodiments, the angle will be between 60 and 120 degrees. As it exits the supply opening, the fluid jet has a first velocity vector. As it enters the discharge opening, the fluid jet has a second velocity vector. In a preferred embodiment, the direction of the second velocity vector is the direction of the first velocity vector after having been rotated 180 degrees.

In some embodiments, the supply opening is disposed at a free end of a supply channel that widens out horizontally towards the supply opening and that narrows in a direction at right angles to the horizontal. Before it widens, the supply channel has a circular cross-section that gradually morphs into an elliptical cross section with a horizontal major axis in the direction of the cleaning fluid's flow, i.e. towards the supply opening. This makes it possible shape the cleaning fluid jet in the supply channel while maintaining a high flow rate and with minimal flow turbulence.

Some embodiments have the discharge opening at a free end of the discharge channel. The free end is that section of the discharge channel immediately upstream of the discharge opening. This end section runs at an angle or curves towards the supply opening. This means that at least a section of the discharge channel that extends through the interior of the cleaning head curves towards the supply opening. Such a configuration promotes suction of cleaning fluid towards the discharge opening.

In other embodiments, a free end of a discharge channel widens horizontally and narrows vertically as it approaches the discharge opening. In some embodiments, the free end has a circular cross section that gradually changes into a non-circular cross section that is wider than it is tall. This promotes more constant distribution of suction across the discharge opening.

Other embodiments include a second discharge opening beneath a first discharge opening, both of which suck. As a result, cleaning fluid that is not sucked away by the first discharge opening has another chance to be sucked away by the second discharge opening. This would include cleaning-fluid mist that arises during the cleaning process and also cleaning fluid that runs downward over the cleaning head.

In some embodiments, the supply opening and the first and/or the second discharge opening are on a common end face of the cleaning head, namely on a front end face that faces the printing head when the cleaning head is in a cleaning position. As a result, the cleaning fluid jet can be configured between the supply opening and the discharge opening along a partial region of this end face. In some of those embodiments that have a second discharge opening, the second discharge opening is in a region of the end face that is set back or recessed relative to a region of the end face in which the supply opening and discharge opening have been provided.

Among the embodiments with a second discharge opening are those in which the second discharge opening opens out into a drip tray. This drip tray collects cleaning fluid that has been recovered through the second discharge opening. The cleaning fluid collected in the drip tray can then be collected and conveyed away, for example by being sucked away.

In those embodiments in which cleaning fluid is conveyed away by suction, one or both of the second discharge opening connects to the discharge channel, for example by a suction line that runs as a branch line to the discharge channel. This permits concurrent extraction of the cleaning fluid that has been recovered through the first discharge opening and that has been recovered through the second discharge opening, including cleaning fluid that has landed in the drip tray.

In another aspect, the invention includes a cleaning device for cleaning printing heads that are provided at printing stations. The cleaning device comprises at least one of the foregoing cleaning heads and a locating device. The locating device positions the cleaning head at a printing head that is to be cleaned. Such a cleaning device is therefore able to hold and align cleaning head at the printing station.

In some embodiments, the locating device comprises an adjustment section that bears against one or more reference faces that have been provided on the printing station for aligning the cleaning head relative to the printing head. In some embodiments, the adjustment section comprises a contact section that lies against one or more of the reference faces and that interacts with them so as to align the adjustment section relative to the printing station, thereby aligning the cleaning head relative to the printing head that is to be cleaned.

Some embodiments feature an adjustment section arranged on a holding section of the locating device. This results in an adjustment section having a variable position. The holding section holds the cleaning device on a suitable carrier, such as a pillar or a frame. The adjustment section moves in one or more directions and/or pivots about one or more axes on the holding section.

In some embodiments, the adjustment section is spring-loaded so as to be pre-tensioned into a sliding or rotating position with requiring an outside force but can be deflected our of this position against the spring force. As a result, it is possible to press against the reference face to move or rotate the adjustment section so as to position the cleaning head in front of the printing head as desired.

In other embodiments, the adjustment section is above the cleaning head were it is configured to interact with a holder that holds the a container directly or that indirectly holds a container by holding a holding-and-centering unit that holds the container.

In yet other embodiments, a reference face that promotes alignment of the adjustment station relative to the printing is station is provided on a container holder that directly accommodates the container. Alternatively, the reference face is provided on a holder that holds and releases a holding-and-centering unit that holds a container. Since the reference face has a local relationship with the print head, it can be used to align the cleaning head relative to the print head.

In another aspect, the invention features a method for cleaning an inkjet print head using a cleaning head that applies cleaning fluid to the print head's nozzles. The method includes emitting cleaning fluid as a fluid jet at a supply opening of the cleaning head and in the direction of a discharge opening provided on the cleaning head and using suction to convey cleaning fluid away at the discharge opening. The method also includes introducing the printing head's nozzles into the cleaning fluid stream formed between the supply opening and the discharge opening so that the nozzles can be cleaned. This method promotes effective cleaning of the print head's nozzles while also avoiding having cleaning fluid running off the print head or dripping from the print head.

One practice includes conveying the cleaning fluid along a flow path that traverses an end face of the cleaning head. This means that the cleaning head does not spray the cleaning fluid onto the nozzles. Instead, the method includes introducing the nozzles into a cleaning fluid stream that extends between the supply opening and the discharge opening over the end face of the cleaning head. In some practices, the introduction of the nozzles into the cleaning fluid stream is carried out by moving the cleaning head toward the printing head so that the fluid stream flows around the nozzles, thereby loosening any deposits and conveying them away.

In some embodiments, the supply opening lies above the discharge opening on the end face that faces the print head. As a result, during cleaning, the cleaning fluid flows in a direction that has a component that is perpendicular to the direction in which the nozzles dispense ink.

As used herein, "cleaning fluid" refers to a water-based or solvent-based cleaning fluid designed to loosen dried-on ink residues.

As used herein, "container" refers to all containers, and in particular, to bottles and cans.

As used herein, expressions such as "substantially" or "around" refer to variations from an exact value by ±10%, preferably by ±5% and/or variations that are insignificant to function.

Further embodiments, advantages and possible applications of the invention arise out of the following description of embodiments and out of the figures. All of the described and/or pictorially represented features whether alone or in any desired combination are fundamentally the subject matter of the invention independently of their synopsis in the claims or a retroactive application thereof. The content of the claims is also made an integral part of the description.

BRIEF DESCRIPTION OF THE DRAWINGS

The invention is explained in detail below through the use of embodiment examples with reference to the figures, in which:

FIG. 1 shows a perspective view of a first embodiment of a cleaning head;

FIG. 2 shows a sectional view through a median vertical plane of the cleaning head shown in FIG. 1;

DETAILED DESCRIPTION

Figure 3:
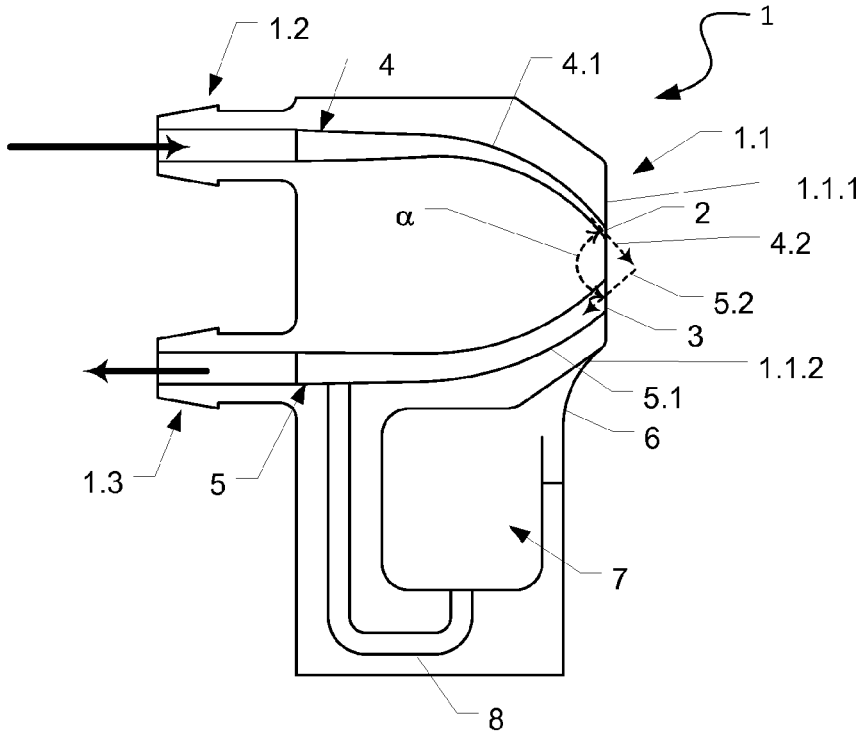
FIG. 3 shows a sectional view through a median vertical plane of an alternative embodiment of a cleaning head.

FIG. 1 shows a cleaning head 1 for cleaning ink-jet print heads that are used for printing on containers. Such a print head has nozzles whose openings extent along a vertical line in a nozzle plane. Each nozzle ejects droplets of ink. These droplets leave residues that are loosened and removed by application of cleaning fluid.

The cleaning head 1 comprises an end face 1.1 that faces the print head during cleaning thereof. The end face 1.1 has a planar section 1.1.1 that is parallel to or substantially parallel to the nozzle plane. A gap separates the end face 1.1, and in particular, the planar section 1.1.1, from the nozzle plane. The separation is typically between 0.1 millimeters and 2 millimeters. Some embodiments have separations between 0.3 millimeters and 1 millimeter. In other embodiments, the separation is at or substantially at 0.5 millimeters.

The end face 1.1 features a supply opening 2 and a first discharge opening 3. The supply opening 2 supplies cleaning fluid; the first discharge opening 3 conveys this supplied cleaning fluid away, generally by suction. With the cleaning head 1 installed correctly, the first discharge opening 3 lies below the supply opening 2, as shown in FIG. 1.

During the cleaning process, a continuous stream of cleaning fluid flows substantially vertically along the end face 1.1 between the supply opening 2 and the first discharge opening 3, typically along an arched or substantially arched path.

In operation, the cleaning head 1 causes a stream of cleaning fluid to flow vertically downward along the end face 1.1 between the supply opening 2 and the first discharge opening 3 in a continuous fluid stream before being sucked away through the first discharge opening 3. In some embodiments, the cleaning fluid stream is arched or substantially arched. This results in an open jet in front of the cleaning head 1, the open jet being a bundled fluid stream.

The cleaning head 1 moves relative to the nozzle arrangement on the print head so that the open jet washes the nozzles. This can be achieved by either having the print head move relative to a stationary cleaning head 1 or vice versa or some combination of both.

In some embodiments, the supply opening 2 and the first discharge opening 3 are both slots, each of which has a longitudinal axis. In some embodiments, the longitudinal axes are parallel to each other.

In other embodiments, the supply opening 2 and the first discharge opening 3 each have a rectangular openings in which the length of the rectangle is much greater than the width. In some embodiments, the supply opening 2 and the first discharge opening 3 are oriented horizontally or substantially horizontally.

In an alternative embodiment, individual openings arranged side-by-side form one or both of the supply opening 2 and the first discharge opening 3. The longitudinal axes of either opening 2, 3 can be horizontal or vertical and spaced apart horizontally so that a fluid stream runs horizontally from the supply opening 2 to the first discharge opening 3.

Referring back to FIG. 1, the supply opening 2 and the first discharge opening 3 are aligned such that the center of the supply opening 2 and the center of the first discharge opening 3 lie along the same vertical line. The supply opening 1 has a supply-opening width b1 and a supply-opening height h1. The first discharge opening 3 has a discharge opening width b2 be and a discharge opening height h2.

The discharge-opening width b2 is greater than the supply-opening width b1. In particular, the discharge-opening width b2 is equal to a product of a factor and the supply-opening width b1. The resulting lateral projection of the first discharge opening 3 beyond the ends of the supply opening 2 promotes its ability to convey away all or nearly all of the cleaning fluid that exits the supply opening 2.

Embodiments include those in which the factor ranges from 1.1 to 1.5. Embodiments also include those in which the factor is 1.2, those in which it is 1.3, and those in which it is 1.4. A factor of 1.2 is particularly useful.

The actual dimensions of the supply-opening width b1 and the discharge-opening width b2 depend on the particular print head that is to be cleaned. A typical value for the discharge-opening width b2 would be between one and three centimeters. In some embodiments, the discharge-opening width is approximately two centimeters. Other embodiments in The supply-opening height h1 is less than the discharge-opening height h2. In fact, the supply opening height h1 is selected to be as small as possible to achieve the highest possible flow rate for the cleaning fluid. In a typical embodiment, the supply-opening height h1 is between 0.2 millimeters and 1.5 millimeters. Embodiments include those in which the supply-opening heights h1 are 0.5 millimeters, 0.6 millimeters, 0.7 millimeters, 0.8 millimeters, 0.9 millimeters and 1 millimeter.

The discharge opening height h2 is also selected to be as small as possible to promote better extraction of cleaning fluid. Embodiments include those in which the height is within a range of two millimeters and five millimeters, and preferably three millimeters or four millimeters. An inter-opening distance d between the supply opening 2 and the first discharge opening 3 is within the range of two millimeters and twenty millimeters, and preferably seven millimeters or fifteen millimeters. In some embodiments, the inter-opening distance is ten millimeters.

FIG. 2 shows a vertical section of the cleaning head 1 shown in FIG. 1 in which it is possible to see a supply channel 4 and a discharge channel 5 within the cleaning head 1.

Figure 4:
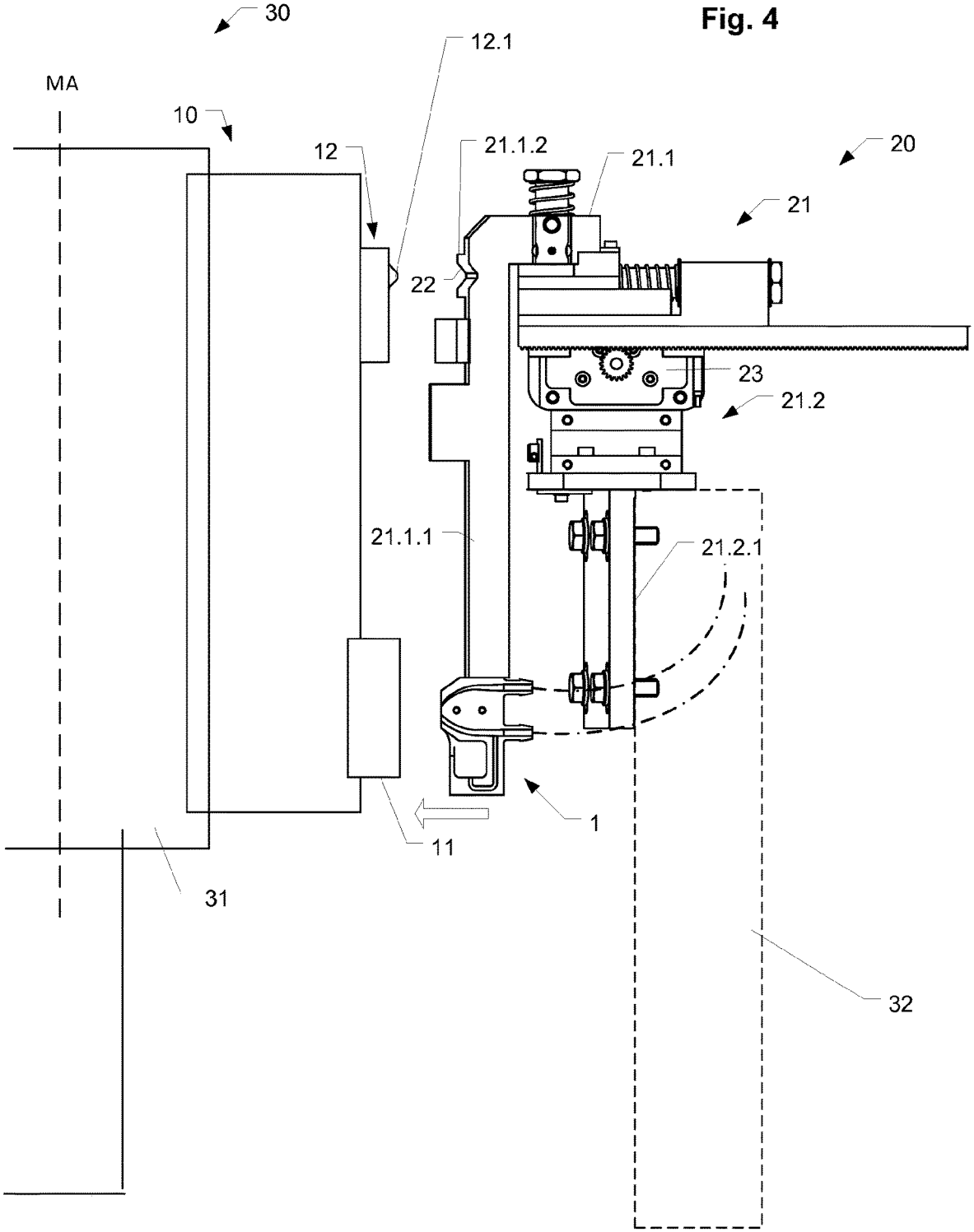
FIG. 4 shows a side view of a cleaning device positioned in front of a printing station.

FIG. 4 shows a printing station 10 having a print head 11 and a cleaning device 20 for cleaning the print head 10. In addition, FIG. 4 shows alternating dot and dash pairs that represent a fluid line for providing cleaning fluid to the cleaning device 20. This cleaning fluid reaches the supply channel 4 via a first connecting region 1.2.

The supply channel 4 also has an end section 4.1 that curves towards the first discharge opening 3 and that opens out into the supply opening 2. The end section 4.1 thus runs towards the first discharge opening 3. In doing so, it reduces the distance between the supply channel 4 and the discharge channel 5 as cleaning fluid traverses the supply channel 4 towards its supply opening 2. This ensures that cleaning fluid emerging from the supply opening 2 does not leave in a direction perpendicular to the end face 1.1 but leaves with a component of velocity directed toward the discharge opening.

As a result, the cleaning fluid does not leave the supply opening 2 in a direction perpendicular to the end face 1.1 of the cleaning head 1. Instead, it leaves with a flow velocity having a component that is directed toward the first discharge opening 3. The cleaning fluid is therefore deflected toward the first discharge opening 3 by the end section 4.1 of the supply channel 4, i.e. deflected downward when in the preferred vertical installation position.

Similarly, the discharge channel 5 extends between a connecting region 1.3 and an end section 5.1. The connecting region 1.3 connects to a suction line for discharging cleaning fluid. The suction line can be seen in FIG. 4 as line of alternating dots and dash pairs.

The end section 5.1 curves upward as it opens up at the first discharge opening 3. As a result, the end section 5.1 reduces the distance between the discharge channel 5 and the supply channel 4. This tends to avoid having a suction current that is perpendicular to the end face 1.1 but instead promotes having a suction current that leads into the first discharge opening 3.

The supply channel 4 leads cleaning fluid towards the end section 4.1 thereof and out the supply opening 2. The discharge channel 5 conveys used cleaning fluid from the first discharge opening 3, through the end section 5.1 thereof. This used cleaning fluid enters the end section 5.1.

FIG. 3 shows a vertical section view of another embodiment of the cleaning head 1.

The upper section of the cleaning head 1 comprises the supply channel 4 and the discharge channel 5 as well as the supply opening 2 and the first discharge opening 3 as described in connection with FIGS. 1 and 2. Cleaning fluid exits along an exit vector 4.2 to form the fluid jet. Used cleaning fluid enters the end section 5.1 along an entry vector 5.2. The entry vector 5.2 and the exit vector 4.2 form an angle $\alpha$ that is approximately a right angle in a common sectional plane.

Unlike the embodiment shown in FIGS. 1 and 2, the embodiment shown in FIG. 3 has a second discharge opening 6 that opens beneath the first discharge opening 3. The second discharge opening 6 opens on recessed face 1.1.2 that is recessed relative to the planar section 1.1.1. In this embodiment, the end face 1.1 is stepped with the planar section 1.1.1 projecting beyond the recessed face 1.1.2. This second discharge opening 6 provides a second chance to capture used cleaning fluid that the first discharge opening 4 failed to capture. This is particularly useful for cleaning fluid mist and drops of cleaning fluid that are dripping downwards on the cleaning head 1.

A drip tray 7 inside the cleaning head 1 catches any cleaning fluid captured by the second discharge opening 6. A suction line 8 extends between a lower portion of the drip tray 7 and the discharge channel 5. This suction line 8 disposes of used cleaning fluid that falls into the drip tray 7. In some embodiments, a Venturi nozzle disposed where the suction line 8 and the discharge channel 5 couple together improves suction power on the suction line 8.

The cleaning device 20 includes a locator 21 that holds and aligns the cleaning head 1 relative to the print head. The locator 21 includes an adjustment section 21.1 and a holding section 21.2. A holding arm 21.1.1 on which the cleaning head 1 is arranged projects downward from the adjustment section 21.1.

The holding section 21.2 includes an attachment section 21.2.1 that attaches the cleaning device 20 to a carrier element of the printing station 10, such as a column or frame thereof.

A drive 23 moves the cleaning head 1 into a cleaning position by the print head 1. The illustrated drive 23 drives a gear wheel on a rack to move the cleaning head towards or away from the print head 11. Other examples of a suitable drive 23 include a linear drive, a rotary drive, and a pivot drive, all of which are capable of moving a cleaning head 1 into a cleaning position for cleaning a print head 11.

Figure 5:
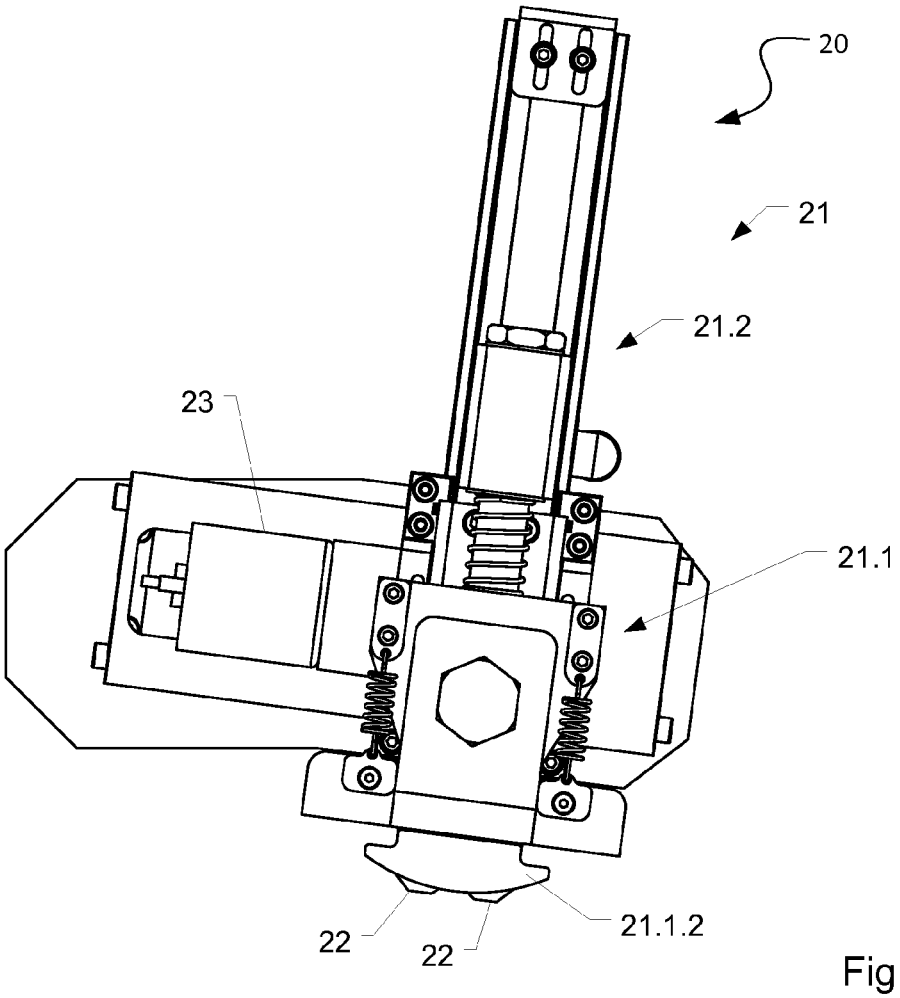
FIG. 5 shows a plan view of a cleaning device having a spring-mounted adjustment section.

The adjustment section 21.1 is arranged on the holding section 21.2 so as to be movable in three orthogonal spatial directions and to pivot about one or more pivot axes. This ensures that the adjustment section 21.1 is able to align the cleaning head 1 relative to the print head 11. As can be seen from the plan view of the cleaning device 20 in FIG. 5, various springs assist in displacing or pivoting the adjustment section 21.1 relative to the holding section 21.2.

The upper region of the adjustment section 21.1 includes a contact section 21.1.2 having a reference face 22 that interacts with a corresponding reference face 12.1 on the printing station 10 to assist in at least partly adjusting the cleaning head 1 relative to the print head 11. The printing station's reference face 12.1 is one that is configured for positioning the cleaning head 1.

In some embodiments, the adjustment section 21.1 moves toward the printing station 10 in such a way that the contact section's reference face 22 bears against the printing station's reference face 12.1.

The contact section's reference face 22 and the printing station's reference face 12.1 are configured to align the cleaning head 1 into a target position by moving the adjustment section 21.1 using its movable mounting and by forces exerted by the printing station's reference face 12.1 on the adjustment section 21.1. This makes it possible to position the cleaning 1 close to where it should be and to then carry out a fine adjustment of the position by causing relative motion between the cleaning head 1 and the print head 11, either by moving the cleaning head 1 or moving the print head 11 or some combination of both.

Some embodiments include a holder 12 to which a container to be printed attaches during the printing process.

In some of these embodiments, the container attaches directly to the holder 12. In other cases, the container to be printed upon attaches to a holding-and-centering unit and this holding-and-centering unit is what attaches to the holder 12. This is particularly useful when transferring a container from one printing station to the next, since the connection to the container only needs to be made once. In either case, in such embodiments, the holder 12 also either forms the printing station's reference face 12.1 or attaches to the printing station's reference face 12.1.

A particular advantage of such embodiments is that the printing station's reference face 12.1 enables a holding-and-centering unit attached thereto to be fixed in a desired position on the printing station 10. In some of these embodiments, the holder 12 achieves this by having multiple printing section reference faces 12.1, each of which is shaped so as to interact with a complementary shape at the contact section's reference face 22. Suitable shapes include a frustoconical shape or one that bows to form a convexity. The use of complementary reference faces promotes the ability to achieve a desired positioning of the cleaning head 1 relative to the print head 11.

Some embodiments rely on a magnet to fix the adjustment section 21.1 to the printing station 10. Such a magnet exerts a force that promotes alignment of the cleaning head 1 through the interaction of the contact section's reference face 22 and the printing section's reference face 12.1. Embodiments include those in which the magnet is a permanent magnet and those in which it is an electromagnet. Also among the embodiments are those in which the magnet is placed in the region of the printing station 10, in the region of the adjustment section 21.1, or both.

As shown in FIG. 4, the printing stations 10 are disposed on the periphery of a transport element 31 that rotates about a vertical machine-axis M to form a rotary printing device 30. In the particular embodiment shown, each printing station 10 is an interchangeable printing segment that can be removed as a unit and swapped with other interchangeable printing segments elsewhere on the rotary printing device 30. Each of these modular printing segments has a print head 11 and a holder 12 that holds a holding-and-centering unit. A frame 32, or alternatively, a pillar, supports the cleaning device 20

When neither a container nor a holding-and-centering unit are present, it is possible for the adjustment section 21.2 to move radially towards the print head 11. This causes the contact section's reference face 22 to contact one of the printing station's reference faces 12.1.

In the process, the contact section's reference face 22 contacts one or more of the printing station's reference faces 12.1 to position the cleaning head 1 at approximately the correct position relative to the print head 11. A fine adjustment can then be carried out to bring the cleaning head 1 into the desired position in front of the print head's nozzles.

In some embodiments, the cleaning head 1 is positioned at a distance of between 0.1 millimeters and 2 millimeters from the print head 11. Among these are embodiments in which a distance between 0.3 millimeters and 1 millimeter separates the print head and the cleaning head. In a particular embodiment, the free ends of the printing head's nozzles are 0.5 millimeters from the cleaning head 1.

After having correctly positioned the cleaning head 1 and the print head 11, cleaning proceeds with execution of relative motion between the cleaning head 1 and the print head 11. In those cases where the print head's nozzles are disposed along a vertical line, this relative motion is a vertical motion in which the nozzles are cleaned in sequence. Some embodiments carry out the relative motion such that the nozzles are cleaned from top to bottom. However, it is possible to clean the nozzles from bottom to top instead.

The configuration described herein makes it possible for a cleaning head 1 to emit cleaning fluid through supply opening 2, to have it strike the printing head's nozzles, and to immediately recover it using either the first discharge opening 3 or both the first and second discharge openings 3, 6. This suppresses the tendency for cleaning fluid to flow downward all the way to the lower end of the printing head 11.

Instead, the cleaning head 1 generates a fluid stream that is continuous during the entire process of cleaning the printing head 11 and that runs in a spatially limited region along an end face of the cleaning head 1. During this process, the nozzles to be cleaned are introduced into this stream.

The presence of cleaning fluid within only a spatially limited region is particularly advantageous because having the cleaning fluid drain away from or drip from the print head 11.

Having described the invention, and a preferred embodiment thereof, what is claimed as new and secured by Letters Patent is:

1. An apparatus for cleaning an inkjet print head, said apparatus comprising a cleaning head, said cleaning head comprising an end face, a supply channel, a supply opening, a discharge opening, and a discharge channel, wherein said supply channel carries, to said supply opening, cleaning fluid to be used for cleaning said inkjet print head, wherein said discharge opening receives cleaning fluid that is to be conveyed away after having been emitted through said supply opening, wherein said supply opening and said discharge opening are arranged to be spaced apart on said end face, wherein said end face faces said print head during cleaning thereof, wherein said cleaning head emits a cleaning fluid jet through said supply opening with said cleaning fluid jet being emitted in a direction having a component that is directed towards said discharge opening so that said cleaning fluid can be conveyed away by suction through said discharge opening.

2. The apparatus of claim 1, wherein said supply channel comprises an end section that is angled towards said discharge opening.

3. The apparatus of claim 1, wherein said discharge channel comprises an end section that is angled toward said supply opening.

4. The apparatus of claim 1, wherein, when said cleaning head is installed and ready for use, said supply opening is disposed above said discharge opening.

5. The apparatus of claim 1, wherein said supply opening is a slot having an opening width and an opening height that is less than said opening width and said discharge opening is a slot and wherein said discharge opening is a slot having an opening width and an opening height that is less than said opening width.

6. The apparatus of claim 1, wherein at least one of said discharge opening has a width that is greater than that of said supply opening and said discharge opening has a height that is greater than that of said supply opening.

7. The apparatus of claim 1, wherein the supply opening is provided at a free end of a supply channel, wherein said supply channel widens horizontally along a direction leading toward said supply opening, and wherein said supply channel narrows vertically along said direction.

8. The apparatus of claim 1, wherein said discharge opening is at a free end of a discharge channel, wherein said discharge channel widens horizontally in a direction leading toward said discharge opening, and wherein said discharge channel narrows vertically in said direction.

9. The apparatus of claim 1, wherein said discharge opening is a first discharge opening, said apparatus further comprising a second discharge opening disposed below said first discharge opening.

10. The apparatus of claim 9, wherein said cleaning head comprises an end face, wherein said supply opening, said first discharge opening, and said second discharge opening are disposed on said end face.

11. The apparatus of claim 10, wherein second discharge opening connects to said drip tray.

12. The apparatus of claim 9, wherein said cleaning head further comprises a drip tray and wherein said second discharge opening opens out into said drip tray.

13. The apparatus of claim 10, wherein second discharge opening connects to said discharge channel.

14. The apparatus of claim 1, further comprising a printing station and a locator, wherein said print head is disposed at said printing station, wherein said locator positions said cleaning head in front of said print head, wherein said printing station comprises reference faces, and wherein said locator comprises an adjustment section that bears against at least one of said reference faces.

15. The apparatus of claim 14, comprising a holding section, wherein said adjustment section is arranged on said holding section so as to be variable in position.

16. The apparatus of claim 14, wherein said adjustment section is above said cleaning head and wherein said adjustment section is configured to interact with a structure selected from the group consisting of a container and a holding-and-centering unit.

17. The apparatus of claim 1, wherein the emitted cleaning fluid jet forms an arched cleaning-fluid stream that, after having traversed a travel path in front of said end face as a free stream, is directly sucked away through said discharge opening.

18. A method comprising using a cleaning head to clean an inkjet print head, wherein using said cleaning head comprises, from a supply opening of said cleaning head, emitting cleaning fluid in a direction having a component leading toward a discharge opening of said cleaning head, sucking said cleaning fluid through a said discharge opening thereby forming a cleaning fluid stream that extends from said supply opening to said discharge opening, and introducing said nozzles to be cleaned into said cleaning fluid stream.

19. The method of claim 18, wherein said cleaning fluid stream is an arched cleaning fluid stream, a portion of which traverses a flow path along an end face of said cleaning head.

20. The method of claim 18, wherein said discharge opening is below said supply opening, said method further comprising causing said cleaning fluid to flow from said supply opening to said discharge opening along an end face of said cleaning head in a direction perpendicular to a direction in which said print head's nozzles dispense ink, wherein said flow includes an arched cleaning fluid stream.

* * * * *